US011225763B2

(12) United States Patent
Upson

(10) Patent No.: US 11,225,763 B2
(45) Date of Patent: Jan. 18, 2022

(54) DEVICE FOR THWARTING VEHICULAR STUNTS

(71) Applicant: City of Benicia, Benicia, CA (US)

(72) Inventor: Erik M. Upson, Benicia, CA (US)

(73) Assignee: CITY OF BENICIA, Benicia, CA (US)

( * ) Notice: Subject to any disclaimer, the term of this patent is extended or adjusted under 35 U.S.C. 154(b) by 0 days.

(21) Appl. No.: 16/526,924

(22) Filed: Jul. 30, 2019

(65) Prior Publication Data

US 2020/0048850 A1 Feb. 13, 2020

Related U.S. Application Data

(60) Provisional application No. 62/714,618, filed on Aug. 3, 2018.

(51) Int. Cl.
*E01F 13/12* (2006.01)

(52) U.S. Cl.
CPC ..... *E01F 13/12* (2013.01)

(58) Field of Classification Search
CPC ..... E01F 13/12; E01F 9/20
See application file for complete search history.

(56) References Cited

U.S. PATENT DOCUMENTS 2,666,373 A * 1/1954 Mattson ..... E01F 9/553 404/16
3,179,009 A * 4/1965 Sheffield ..... E01F 9/553 404/16
3,764,446 A * 10/1973 Martin ..... E01C 9/086 428/52
4,382,714 A * 5/1983 Hutchison ..... E01F 13/12 404/6
4,544,303 A * 10/1985 Glasmire ..... E01F 13/12 116/63 P
4,860,476 A * 8/1989 Hall ..... G09F 21/04 40/593
5,099,579 A * 3/1992 Chadwick ..... B26F 1/24 30/358

(Continued)

FOREIGN PATENT DOCUMENTS

CH 446125 A * 10/1967 ..... F41H 11/08
EP 3323942 A1 * 5/2018 ..... E01F 13/022
FR 2986017 A3 * 7/2013 ..... E01F 13/105

OTHER PUBLICATIONS

Mini Standing Grater with Magnet. Website "https://www.littleobsessed.com/mini-standing-grater-with-magnet/?gclid=Cj0KCQjwyZmEBhCpARIsALIzmnKZQjG9JafELfO3A9NgizHu_0JU7F2dJrKUpxivXC9BgxTBsxtEh_EaAmL7EALw_wcB" Reviews of the product show that the product has been sold since at least 2014. (Year: 2014).*

*Primary Examiner* — Thomas B Will
*Assistant Examiner* — Katherine J Chu
(74) *Attorney, Agent, or Firm* — Squire Patton Boggs (US) LLP

(57) ABSTRACT

This invention relates to a selective tire-impairment device attachable to a roadway surface. The device can include a lateral surface having a piercing element. The piercing element can be oriented downward to selectively impair a sidewall of a tire traveling laterally without affecting a tire traveling in a typical forward direction. The piercing element can severely damage a tire of a vehicle performing a stunt, commonly referred to as a doughnut, due to the lateral direction of travel of a tire during the stunt.

14 Claims, 13 Drawing Sheets

(56) References Cited

U.S. PATENT DOCUMENTS

| | | | | | |
|---|---|---|---|---|---|
| 5,247,815 | A * | 9/1993 | Caldwell | B60R 25/093 | 188/32 |
| 5,322,385 | A * | 6/1994 | Reisman | E01F 13/12 | 256/1 |
| 5,482,397 | A * | 1/1996 | Soleau | E01F 13/12 | 404/6 |
| 5,711,491 | A * | 1/1998 | Molo | A47J 43/25 | 241/95 |
| 6,224,291 | B1 * | 5/2001 | Mateychuk | E01F 13/123 | 404/6 |
| 6,749,362 | B1 * | 6/2004 | Eichenberg | E01F 13/12 | 404/6 |
| 7,118,305 | B1 * | 10/2006 | Corbett | E01F 13/12 | 404/6 |
| 7,955,395 | B2 * | 6/2011 | Shea | A61F 2/4637 | 623/22.28 |
| 10,508,393 | B1 * | 12/2019 | Page | E01F 13/02 | |
| D912,480 | S * | 3/2021 | Cloutier | D7/678 | |
| 2003/0175076 | A1 * | 9/2003 | Albritton | E01F 15/146 | 404/6 |
| 2005/0006505 | A1 * | 1/2005 | McNeeley | A47J 43/25 | 241/95 |
| 2005/0147466 | A1 * | 7/2005 | Crowley, Sr. | E01F 13/12 | 404/73 |
| 2011/0070022 | A1 * | 3/2011 | Dandy | E01F 13/12 | 404/6 |
| 2014/0199118 | A1 * | 7/2014 | Wersching | E01F 13/12 | 404/6 |

* cited by examiner

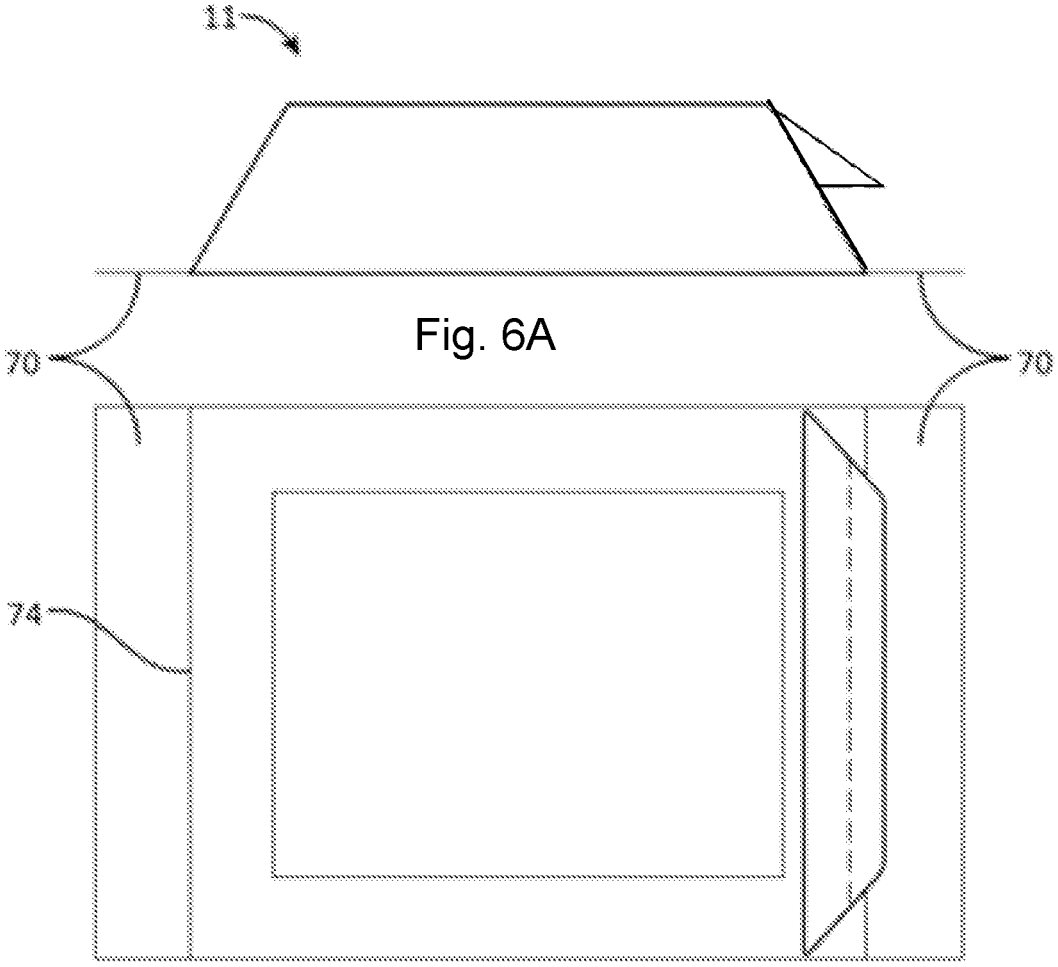
Fig. 6A
Fig. 6B
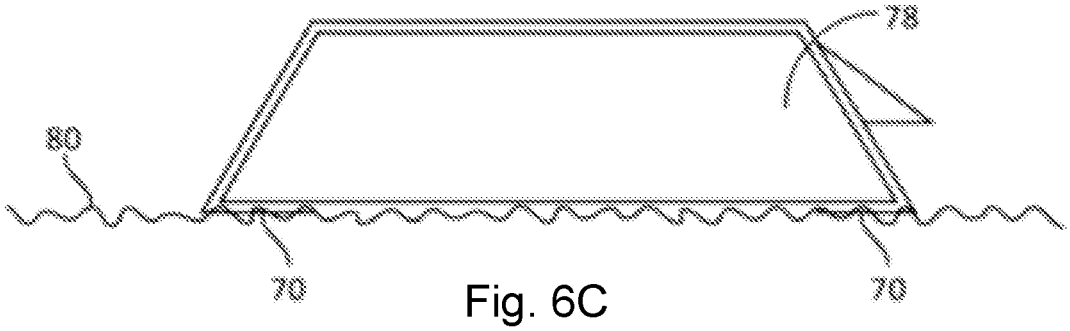
Fig. 6C

DEVICE FOR THWARTING VEHICULAR STUNTS

CROSS-REFERENCE TO RELATED APPLICATION

This application claims the benefit of U.S. Provisional Patent Application No. 62/714,618, filed on Aug. 3, 2018, which is incorporated herein in its entirety.

FIELD OF THE INVENTION

This invention relates to the field of public safety by discouraging or ending illegal vehicular stunts or "side shows" that involve a maneuver known as doughnuts.

BACKGROUND

The so-called vehicular "side show" began in the 1980s in East Oakland, Calif. as an informal exhibition of vehicular stunts, in particular the stunt known primarily as "doughnuts" but also referred to as "spinning sedys," "cutting cookies," "round brownies," and "diffing." The maneuver is performed by rotating the front or rear of the vehicle around the opposite set of wheels in a continuous motion that results in a circular pattern of skid marks on the roadway accompanied by a great deal of smoke generated by the friction of the rotating tires on the roadway.

Performing doughnuts can be hazardous as the result of the extreme strain placed on the vehicle's suspension and drivetrain where failure of either or both of these mechanical elements can result in loss of control of the vehicle. In addition, the severe strain placed on the tires can easily result in a blow-out. Even when all is well, relatively speaking, the rapidly rotating vehicle poses considerable danger to bystanders.

While side shows are generally discouraged, on public roadways they are strictly illegal and the participants—and it has been suggested that even spectators—may be subject to a variety of sanctions including impoundment of vehicles. Since side shows tend to occur sporadically and without much notice except within the participating community, some police department have even opened substations in areas known to be frequented by side shows to be able to more rapidly deploy to the scene.

The problem with side shows and the primary reason for their illegality is the great harm they pose to public safety. When major intersections or even open roadways are usurped by a road show, normal traffic can be substantially affected. More importantly, the possibility of personal injury is very prevalent and serious harm, including deaths have been a not uncommon occurrence at road shows. Serious injuries and even deaths have been reported among side show attendees as the result of the extreme excitement accompanying these events.

To date, the only response to road shows has been, as mentioned above, for police to attempt to deploy to locations where they are occurring as rapidly as possible and to disperse the event. A more proactive approach, one that directly affects the road show even in the absence of authorities would be a major advance in dealing with road shows. This invention provides such a device and its use in thwarting vehicular road shows.

SUMMARY

Thus, an aspect of this invention is a device for thwarting vehicular "side shows," comprising a construct having at least one lateral surface from which protrude(s) one or more cutting elements or a plurality of puncturing elements that, when contacted with a sidewall of a rapidly spinning tire, will slice into or puncture the sidewall of the tire and incapacitate it.

In an aspect of this invention the construct further comprises a bottom surface adapted for coupling the construct to the surface of a paved roadway, a top surface having essentially the same shape as the bottom surface but of proportionately smaller dimensions and additional lateral surfaces wherein all lateral surfaces connect the bottom surface to the top surface at an inward facing acute angle relative to the bottom surface.

In an aspect of this invention, one lateral surface comprises the cutting or the puncturing elements.

In an aspect of this invention, the construct comprises a truncated rectangular pyramid.

In an aspect of this invention, the truncated rectangular pyramid is a truncated square pyramid.

In an aspect of this invention, the truncated square pyramid has a vertical height from about 1 inch to about 3 inches, and ranges therebetween (e.g., 1.5 inches to about 2.5 inches, 1.2 inches to about 2.4 inches, etc.).

In an aspect of this invention, each lateral surfaces of the truncated square pyramid have an angle of inclination of about 25° to about 60°.

In an aspect of this invention, the cutting element comprises a triangular prism wherein the lateral surface of the pyramid from which the prism protrudes is a base of the prism, the edge opposite the base is sharpened and forms a vertex of the triangular prism and an upper surface of the prism that forms the sharpened edge is at an angle with the base of about 30° to about 65°.

In an aspect of this invention, the puncturing element comprises an elongate member having a sharpened tip and a central bore.

In an aspect of this invention, the elongate member has a triangular cross-section.

In an aspect of this invention, the elongate member is adapted to break away from the lateral face after puncturing the sidewall of a tire.

In an aspect of this invention, the bottom surface is scored and is affixed to the roadway surface with an adhesive material.

In an aspect of this invention, an elongate spike extends outward from the bottom surface, the spike being inserted into a hole drilled into the roadway surface and being affixed therein with an adhesive material.

In an aspect of this invention, the elongate spike is threaded and is screwed into a pilot hole drilled into the roadway surface.

In an aspect of this invention, the construct is hollow and comprises interior dimensions that conform to the exterior dimensions of a commercial raised pavement marker such that each surface of the construct is contiguous with a corresponding surface of the commercial raised pavement marker.

In an aspect of this invention, the construct is coupled to the commercial raised pavement marker with an adhesive material between the contiguous surfaces or the construct comprises tabs on a lower edge of each lateral surface, which tabs are bent under the pavement marker prior to the pavement marker being adhered to the roadway such that the tabs are securely trapped between the pavement marker and the roadway.

In an aspect of this invention, the construct comprises a polymer.

In an aspect of this invention, the polymer is a composite.

In an aspect of this invention, the construct comprises a metal.

BRIEF DESCRIPTION OF THE DRAWINGS

Non-limiting examples of the present disclosure will be described with reference to the appended drawings.

FIGS. 6A-6C show a construct of a selective tire-puncturing device configured to attach to a surface

DETAILED DESCRIPTION

Figure 1A:
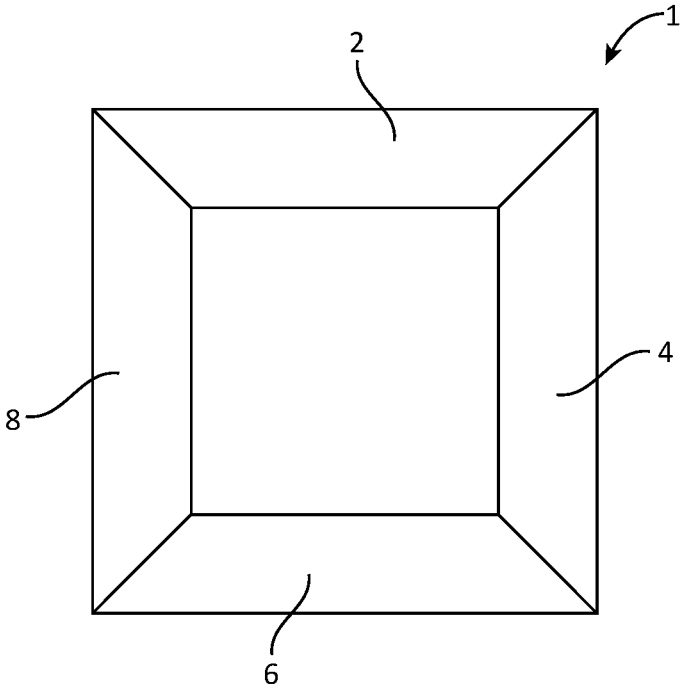
FIG. 1A shows a top-down view of an example construct for a selective tire-puncturing device.
Figure 1B:
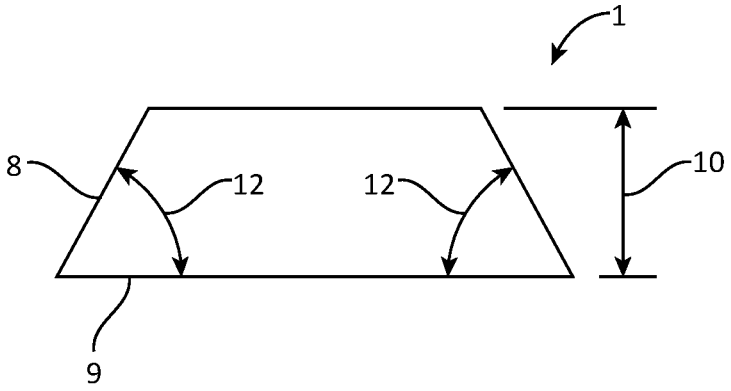
FIG. 1B shows a profile view of the construct shown in FIG. 1A.

It is understood, with regard to this description and the appended claims, that reference to any aspect of this invention made in the singular includes the plural and vice versa, unless it is expressly stated or unambiguously clear from the context that such is not intended. For instance, reference to a "piercing element" in the singular includes two or more piercing elements.

As used herein, any term of approximation such as, without limitation, near, about, approximately, substantially, essentially and the like, mean that the word or phrase modified by the term of approximation need not be exactly that which is written but may vary from that written description to some extent. The extent to which the description may vary will depend on how great a change can be instituted and have one of ordinary skill in the art recognize the modified version as still having the properties, characteristics and capabilities of the word or phrase unmodified by the term of approximation. In general, but with the preceding in mind, a numerical value herein that is modified by a word of approximation may vary from the stated value by ±15%, unless expressly stated otherwise.

As used herein, the use of "preferred," "preferably," or "more preferred," and the like refers to preferences as they existed at the time of filing of this patent application.

As used herein, a vehicular "side show" refers to an event of the kind described in the foregoing introduction. While various types of stunts are often performed such as "doughnuts" and "ghosting"; that is, exiting a moving vehicle to performing dances or other activities alongside the still moving vehicle or climbing up onto the hood or roof of the vehicle to perform such actions, it is doughnuts to which this invention is directed. A doughnut can be performed by locking the brakes of either the front or rear wheels of a vehicle and then applying the throttle causing the other set of wheels to spin rapidly. The vehicle does not move forward because one set of wheels are locked; rather, the vehicle moves in a circular pattern with the spinning wheels moving tangentially to the circular pattern. It is the tires of the tangentially moving wheels that are the object of this invention.

As used herein, "thwarting" refers to discouraging doing doughnuts in the first place due to knowledge that the chosen site is or may be protected by devices of this invention or to abruptly stopping the activity due to the severe damage inflicted on the tires of vehicles performing doughnuts.

As used herein, a "construct" simply refers to a three-dimensional object. For the purpose of this invention, the object may take any desired shape but it must have at least one surface. For example, the construct can include a lateral surface, from which protrudes a piercing element.

As used herein, a "piercing element" refers to any element configured to penetrate, run through, make a hole or opening in, bore into, perforate, or enter into a tire to cause damage. Various type of piercing elements are discussed including, for example, a cutting element and a penetrating element. The piercing elements (e.g., cutting and/or penetrating elements) can be situated so as to intercept the sidewall of a spinning tire and to shred the sidewall with the cutting element or to deflate the tire with the puncturing elements, rendering the tire useless and thereby incapacitating the vehicle.

While it is possible to use a construct of any desired shape so long as it has at least one lateral face from which protrude cutting or puncturing elements disposed in such a manner as to be capable of intercepting a rapidly spinning tire at the level of the sidewall, it is preferred that the construct is a truncated pyramid. A truncated pyramid has a planar bottom surface that comprises a geometrical shape such as a rectangle, square, pentagon, hexagon and the like and a top surface that is created by slicing the pyramid in a plane that is parallel to the plane of the bottom surface. One of more of the lateral surfaces that connect the bottom surface to the top surface at an acute angle with the bottom surface then comprises the cutting or puncturing elements. It is presently preferred that the construct be a truncated square pyramid, 1 in FIGS. 1A (top view) and 1B (side view). The truncated square pyramid will henceforth be referred to simply as the "pyramid" for the sake of brevity. In an embodiment, only one of four lateral surfaces, FIGS. 1, 2, 4, 6, and 8 of pyramid 1 comprise the cutting or puncturing elements. In another embodiment, more than one of the four lateral surfaces of pyramid 1 can comprise cutting or puncturing elements.

While the remainder of this disclosure will be directed specifically to a pyramid, it is understood that those skilled in the art will be able to adapt the discussion which follows, in particular the cutting and puncturing elements of this invention, to a myriad of other constructs (e.g., a dome or cubic shape), and all such constructs are within the scope of this invention.

While any or all of the lateral surfaces of the pyramid may be furnished with cutting or puncturing elements, it is presently preferred that only one face be so adapted.

The overall height 10 of pyramid 1 is from about 1" to about 3" with the cutting or puncturing elements being from about 1.5" to 2.5" up from base 9 although other heights may be used if determined to be closer to optimal for achieving the desired function of the device, the destruction of the tire of a vehicle performing an doughnut.

It is also presently preferred that each of lateral surfaces 2, 4, 6, and 8 have angle of inclination 12 (the angle the lateral surfaces make with the base) of about 25° to about 60°.

One or more surfaces of the construct can include a reflective characteristic. For example, a top surface and/or any of lateral surface 2, 4, 6, and 8 can include a reflective characteristic. In an embodiment, the reflective characteristic can result from reflective elements below a translucent or transparent outer surface of the construct. In another embodiment, the reflective characteristic can result from reflective elements on the outer surface of the construct.

Figure 2A:
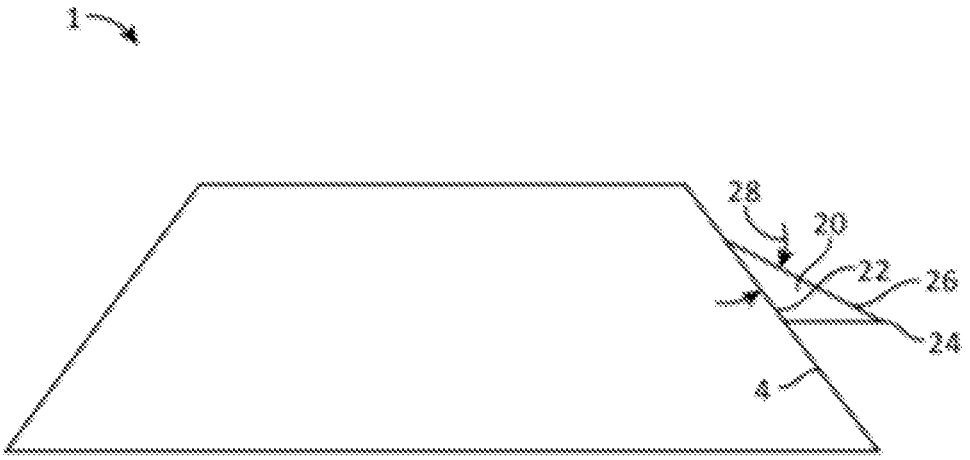
FIGS. 2A-2C shows profile views of example constructs for a selective tire-puncturing device
Figure 2B:
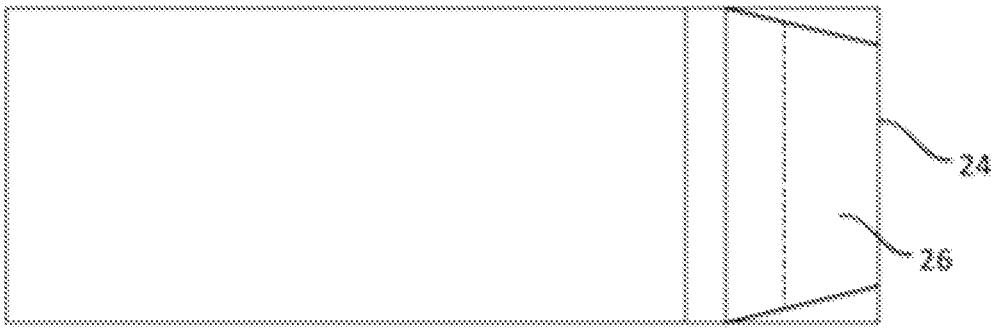
Figure 2C:
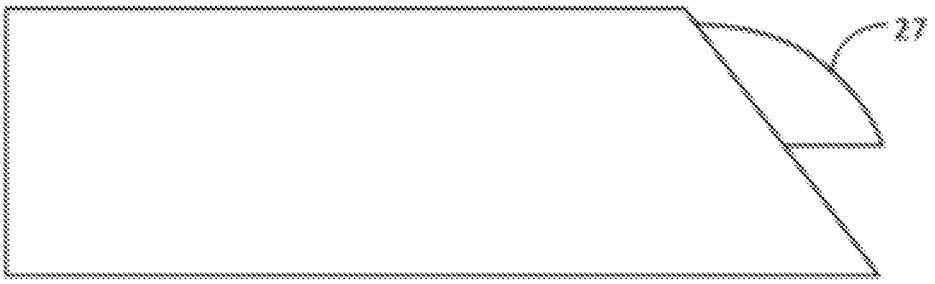
Figure 7A:
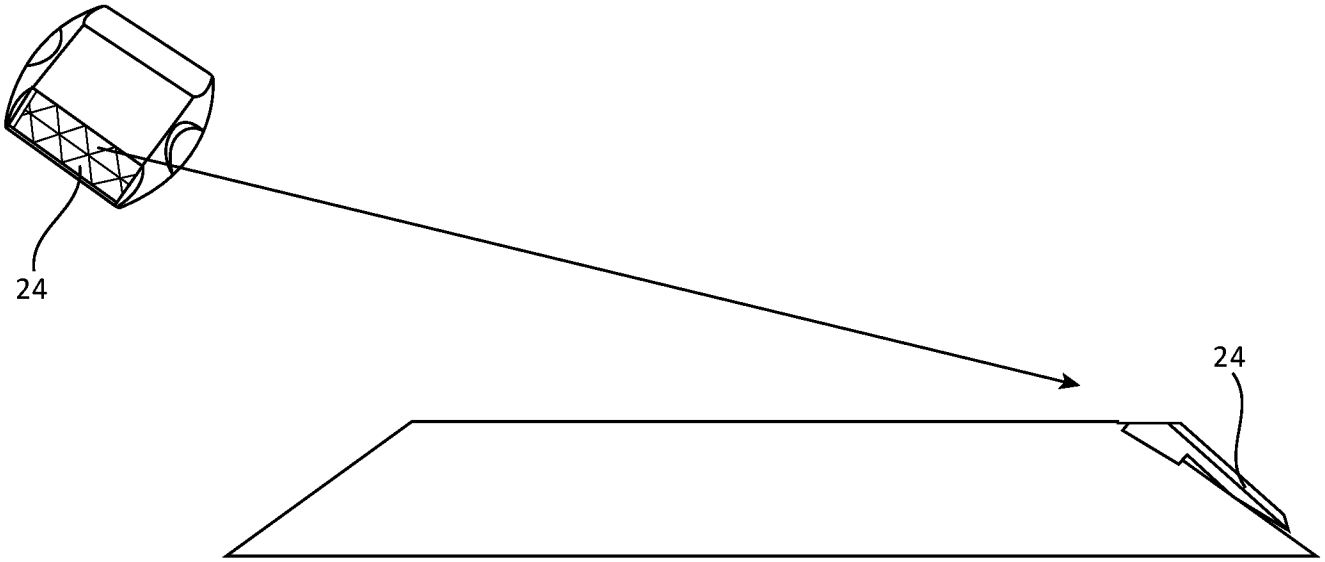
FIG. 7A shows a top-down and profile view of a selective tire-puncturing device having a puncturing element.
Figure 7B:
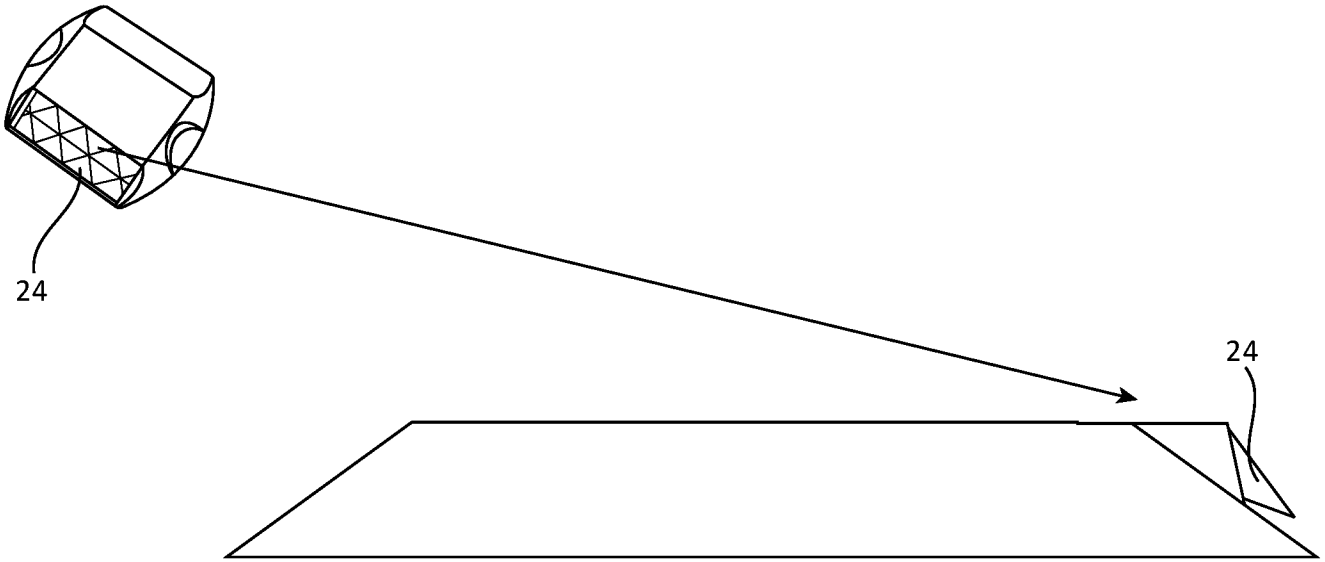
FIG. 7B shows a top-down and profile view of a selective tire-puncturing device having a puncturing element.

Turning now to the cutting element of the selective tire-puncturing device, the cutting element can take the form of triangular prism 20 in FIG. 2A. FIGS. 7A and 7B show another example of a selective tire-puncturing device having the cutting element. Base 22 of prism 20 is formed by lateral surface 4 of pyramid 1. Edge 24 of prism 20 is sharpened so as to be capable of cutting into the sidewall of a spinning tire that contacts it. In order to more easily accommodate regular vehicular traffic passing over the pyramid, surface 26 of prism 20, which terminate in edge 24 forms angle 28 with lateral surface 4, the angle being about 30° to about 60°. It is also possible to have surface 26 of prism 20 curved downward as shown in FIG. 2C, 27, which will also benefit normal vehicular traffic.

An aspect of this invention is that a piercing element (e.g., prism 20) protrudes outward from lateral surface 4 where it can contact the sidewall of a tire traveling laterally, which would be severely damaged. It is anticipated that the sidewall of a rapidly spinning wheel will forcefully contact edge 24 in an essentially perpendicular manner as shown in FIG. 3B. In FIG. 3B, tire 30 is shown contacting edge 24 in direction of arrow 32. When performing a doughnut, tire 30 would be spinning around an axle but would not be moving the vehicle forward. That is, in a direction out of the figure and toward the reader due to braking applied to wheels at the opposite end of the vehicle; thus the perpendicular motion. Sharpened edge 24 can terminate a vehicles ability to perform doughnuts upon impairing one or more of the vehicles tires.

Figure 3A:
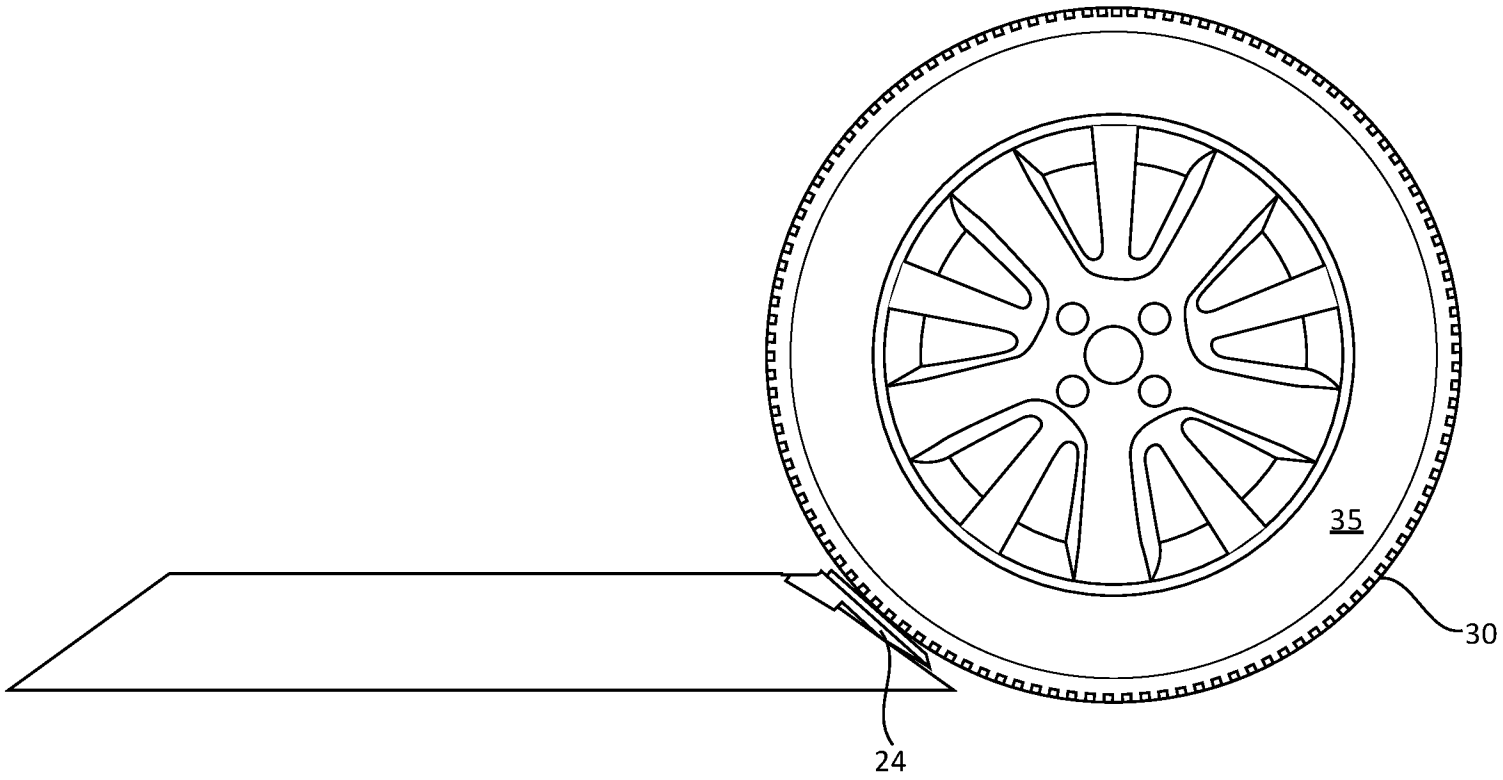
FIG. 3A illustrates a selective tire puncturing device in contact with a front of a tire.
Figure 3B:
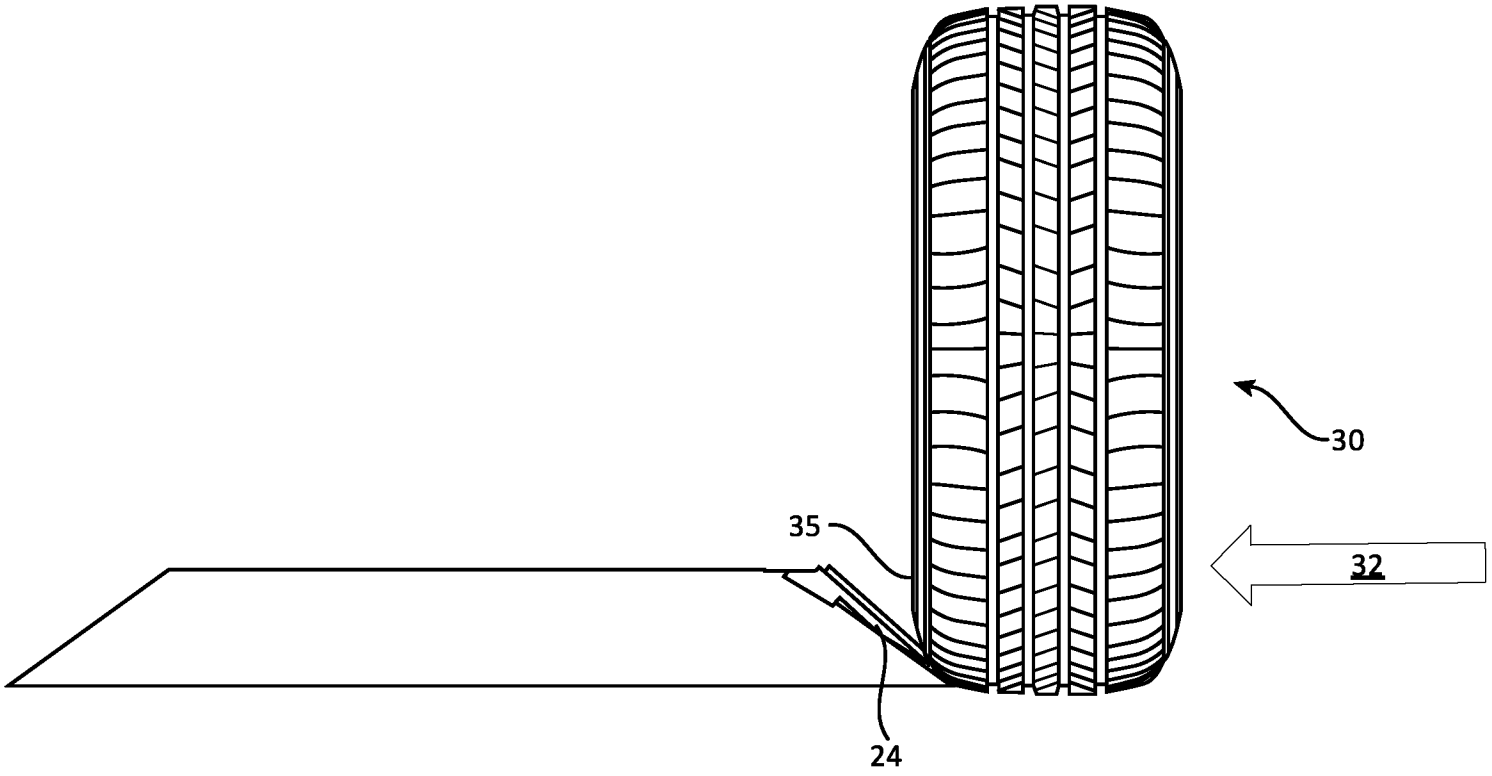
FIG. 3B illustrates a selective tire puncturing device in contact with a sidewall of a tire.
Figure 4:
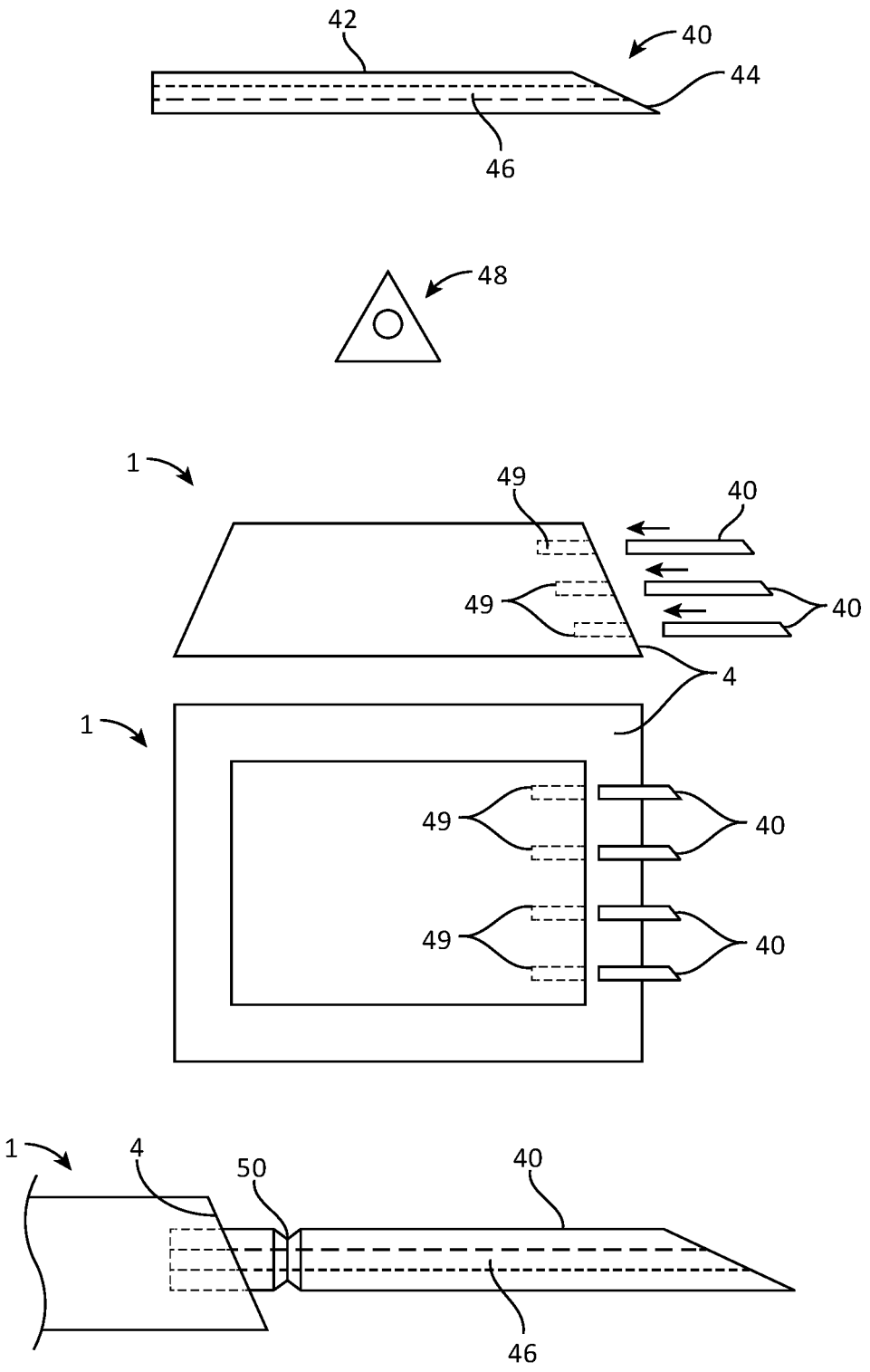
FIG. 4 shows a puncturing element configured to attach to a selective tire-puncturing device.

FIG. 3A illustrates how tire 30 is not affected when tire 30 contacts the selective tire-impairment device in a typical forward or reverse direction. The downward orientation of the piercing element combined with the circular shape of the tire results in the tire being able to travel forward or backward over the selective tire-impairment device without damage. In contrast, sidewall 35 of tire 30 is more perpendicular relative to the ground surface than the circular outer surface of tire 30. As sidewall 35 of the tire 30 moves sideways (e.g., due to a doughnut stunt) toward the selective tire-impairment device, as shown in FIG. 3B, the sidewall 35 comes into contact with the piercing element attached to a lateral surface of the selective tire-impairment device resulting in impairment of the tire 30.

Various types of piercing elements are contemplated including, for example, puncturing elements and cutting elements. If puncturing elements are chosen in lieu of cutting elements, puncturing element 40, FIG. 4, comprises elongate member 42 which has sharpened tip 44 and a central bore 46. It is presently preferred that elongate member 42 have a triangular cross-section, 48. Puncturing elements 40 are coupled to pyramid 1 by means of holes 49 disposed in lateral surface 4 into which puncturing elements 40 are inserted. Holes 49 may be sized so as to make a tight fit when puncturing elements 40 are inserted into them in which case insertion of the puncturing elements is all that is necessary. If desired, puncturing elements 40 may be additionally secured in place by an adhesive material deposited into holes 49. Holes 49 and puncturing elements 40 may, in the alternative be threaded (not shown) so that puncturing elements 40 can be screwed into place.

Puncturing elements 40 may also include a feature that results in the puncturing elements breaking away from lateral surface 4 after penetrating the sidewall of a spinning tire. Such feature may comprise scoring the surface of puncturing element 40, FIG. 4, 50. Since puncturing element 40 comprises bore 46, a punctured tire will deflate after the puncturing element has broken away from its lateral surface.

Figure 8A:
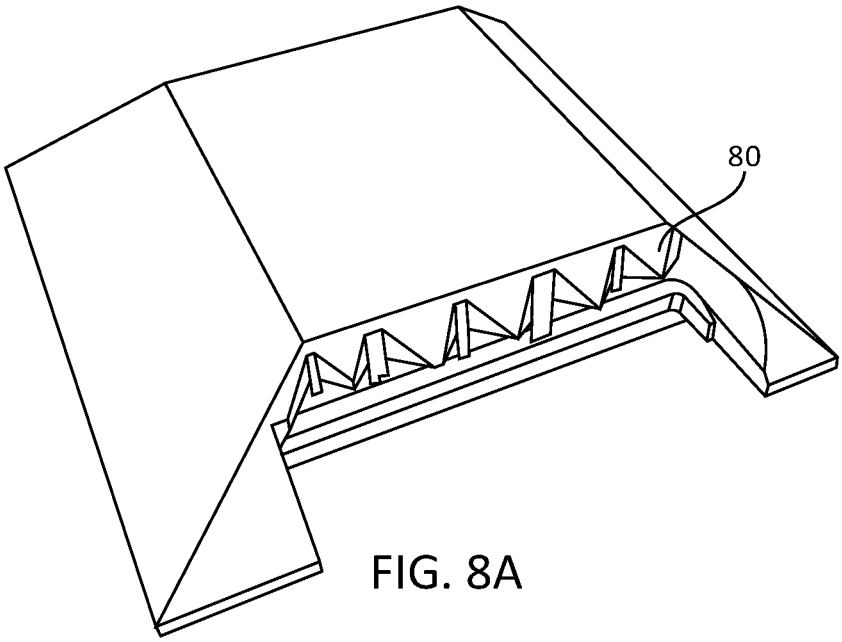
FIG. 8A shows an isometric view of a selective tire-puncturing device having a serrated puncturing element.
Figure 8B:
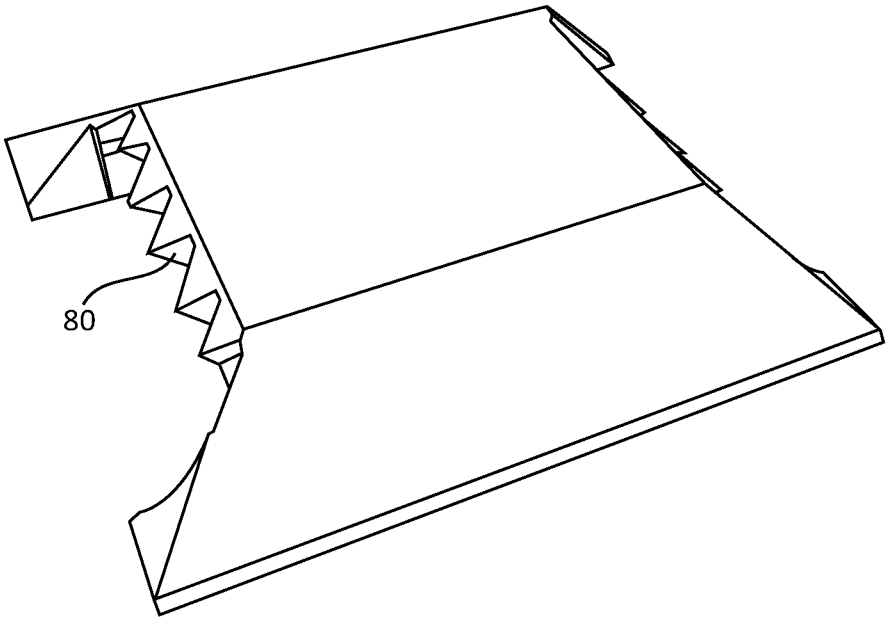
FIG. 8B shows an isometric view of a selective tire-puncturing device having a serrated piercing element.
Figure 9A:
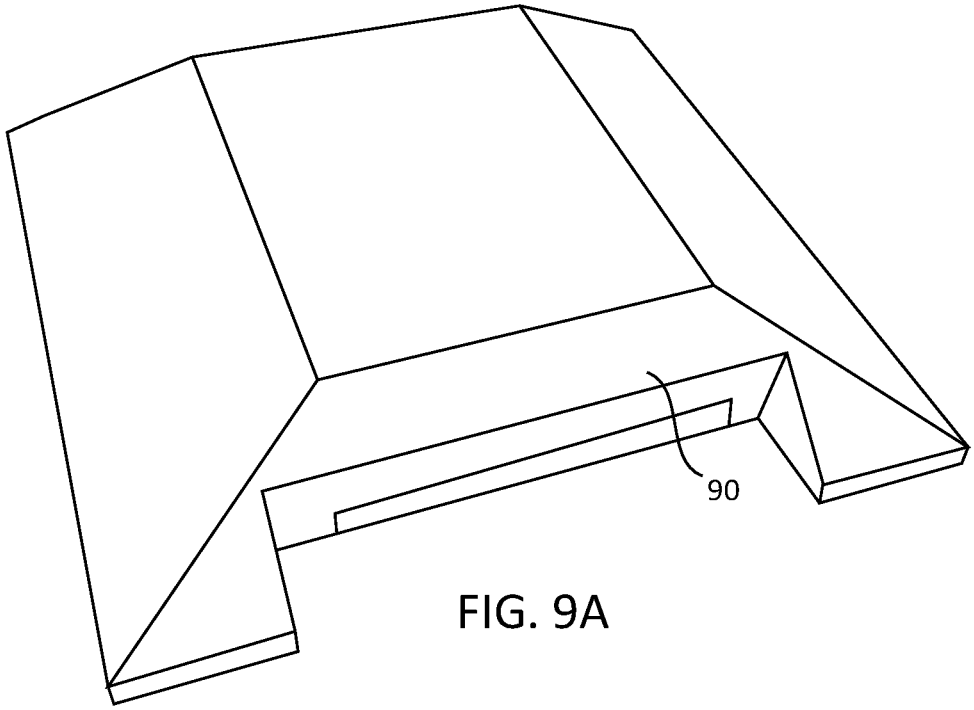
FIG. 9A shows an isometric view of a selective tire-piercing device having a non-serrated or smooth piercing element.
Figure 9B:
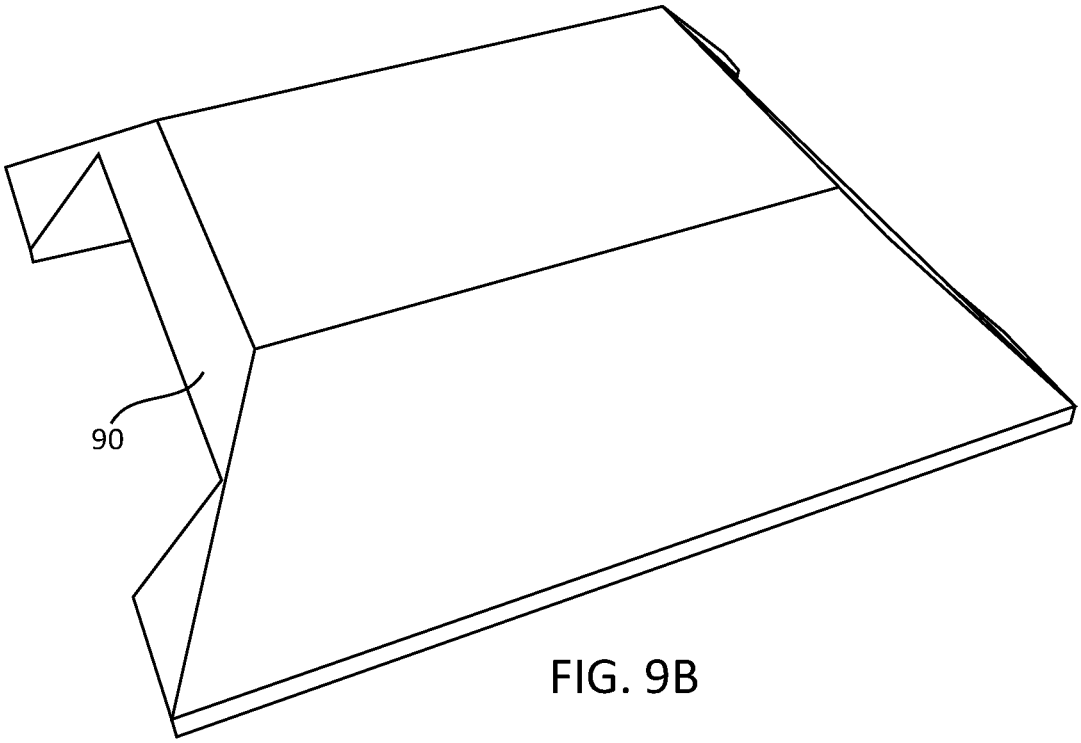
FIG. 9B shows an isometric view of a selective tire-piercing device having a non-serrated or smooth piercing element.

A piercing element (e.g., cutting and/or penetrating elements) can be serrated or non-serrated (e.g., smooth blade or sharpened tip). FIGS. 8A-8B illustrate isometric views of piercing elements 80 having a serrated characteristic. FIGS. 9A-9B illustrate an isometric view of piercing elements 90 having a non-serrated or smooth characteristic.

Piercing elements can be disposed on a single lateral surface or one more than one lateral surface. For example, FIGS. 8A-8B and FIGS. 9A-9B illustrate piercing elements disposed on oppositely oriented lateral surfaces of a truncated pyramid construct. A first piercing element (or set of piercing elements) is disposed on a first lateral surface. A second piercing element (or set of piercing elements) is disposed on a second lateral surface. Although FIGS. 8A-8B and FIGS. 9A-9B illustrate piercing elements disposed on oppositely oriented lateral surfaces, other arrangements are contemplated. For example, piercing elements can be disposed on adjacent lateral surfaces (e.g., neighboring lateral surfaces having 90 degrees of a truncated pyramid construct), on lateral and adjacent lateral surface (e.g., three sides of a truncated pyramid construct), or disposed on all lateral surfaces (e.g., each side of a truncated pyramid construct).

Figure 5:
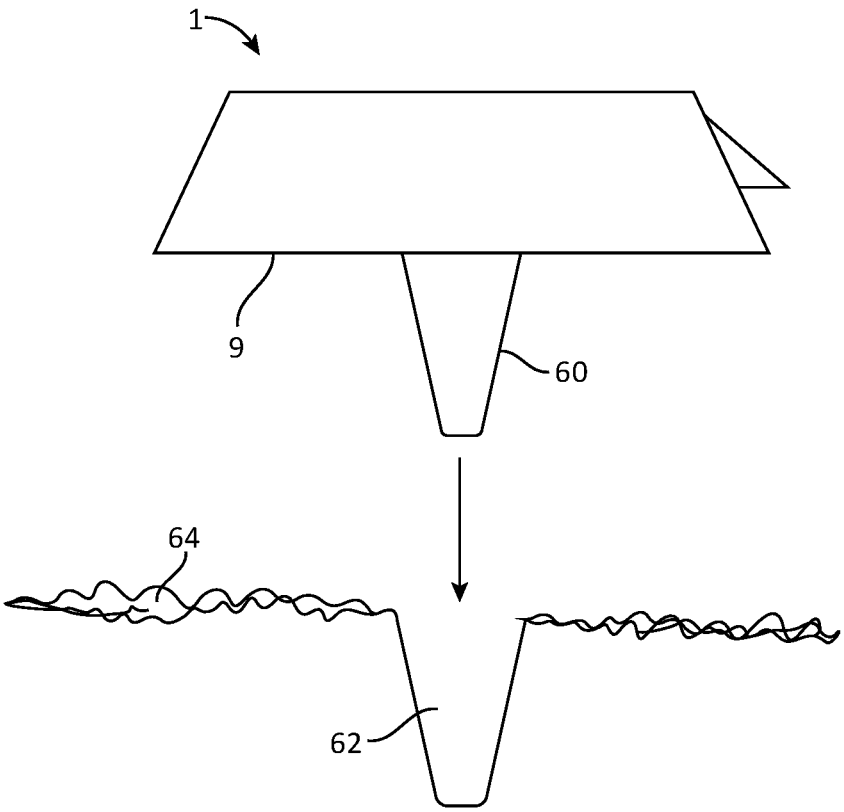
FIG. 5 shows a construct of a selective tire-puncturing device configured to attach to a surface.

A device of this invention can be adapted for coupling to a roadway surface. Such adaptation may take the form of spike 60 that protrudes from bottom surface 9 as shown in FIG. 5. Use of the spike involves creating hole 62 of appropriate size and depth in roadway surface 64 to accommodate spike 60 and to permit bottom surface 9 to be contiguous with roadway surface 64 when the device is in place. Spike 60 is held in place with an adhesive material such as, without limitation, asphalt, tar, concrete, polymeric composite, glue and the like.

Rather than a simple spike, a protruding element from bottom surface 9 may comprise a threaded shaft (not shown). To use this approach, a pilot hole is drilled into the roadway surface and the threaded shaft is screwed into place. It is also possible to include adhesive in the pilot hole to more securely affix the device in place.

Another means of coupling pyramid 1 to a roadway surface is simply to score bottom surface 9 of pyramid 1 to create as much surface area as possible and then glue the construct in place on the roadway surface. Any type of adhesive material deemed appropriate for roadway use, of which many are well-known to those skilled in the art including, but not limited to, the previously mentioned tar, asphalt or polymeric composite may be used to secure pyramid 1 in place. This is a preferred method for securing pyramid 1 or, for that matter, any other construct within the scope of this invention to a roadway surface when the construct is a fully self-contained device that does not involve any other structure such as that discussed below.

It is also an aspect of this invention that the pyramid be hollow and comprise internal dimensions that conform with the external dimensions of an existing commercial pavement marker as such are well-known to those skilled in the art and as such are evident to drivers when on the road. This may in fact be a preferred method of coupling a device of this invention to a roadway in that is makes economic sense to make use of existing materials when possible. Commercial pavement markers come in many configurations such as, without limitation, domes, rectangular pyramids and square pyramids. The internal dimensions of a construct of this invention must be made so as to conform with such external shape but this clearly would pose no special problem to those skilled in the art and need no further explanation here. As an illustration, however, of this approach, commercial pavement marker 78 is shown in FIG. 6 with hollow pyramid 11 placed over it (without for the moment tabs 70, discussed below). Pyramid 11, without tabs 70, is secured in place with an adhesive material of which several have been mentioned previously herein and any of those as well as any other known or discovered in the art may be used.

Another approach to coupling a construct of this invention to a commercial pavement marker is shown in FIGS. 6A-6C. In FIGS. 6A-6C pyramid 11 is shown with bendable tabs 70 at edges 74 of pyramid 11. Pyramid 11 can be place over commercial pavement marker 78 and tabs 70 can be folded under the pavement marker as shown in FIG. 6C. Commercial pavement marker 78 can then be affixed to a roadway surface in whatever manner is usual with such device and pyramid 11 will be held in place by tabs 70, which are between pavement marker 78 and roadway surface 80. Tabs 70 may be placed on two opposing sides of pyramid 11, on three sides or, if desired, on all four sides of pyramid.

While the general shape of a construct of this invention can be any that meets the above criteria and that is amenable to contact with tires of vehicles moving in the normal traffic flow where the tires pass over the construct in a continuous forward motion and the sidewalls are not spinning in place and cannot contact the construct in an essentially perpendicular manner. While the positioning of the cutting or puncturing elements should be sufficient to achieve this goal, it is also possible to make a construct of this invention even more compatible with normal traffic flow by rounding the upper edges of the lateral surfaces of a pyramid herein.

A construct of this invention may be formed of any material of sufficient strength to withstand normal traffic flow and the initial contact with the sidewall of a rapidly spinning tire moving perpendicularly with substantial force. For example, without limitation, the construct may be made a metal, a polymer or a polymeric composite such as, without limitation, a glass or carbon fiber composite.

Figure 10A:
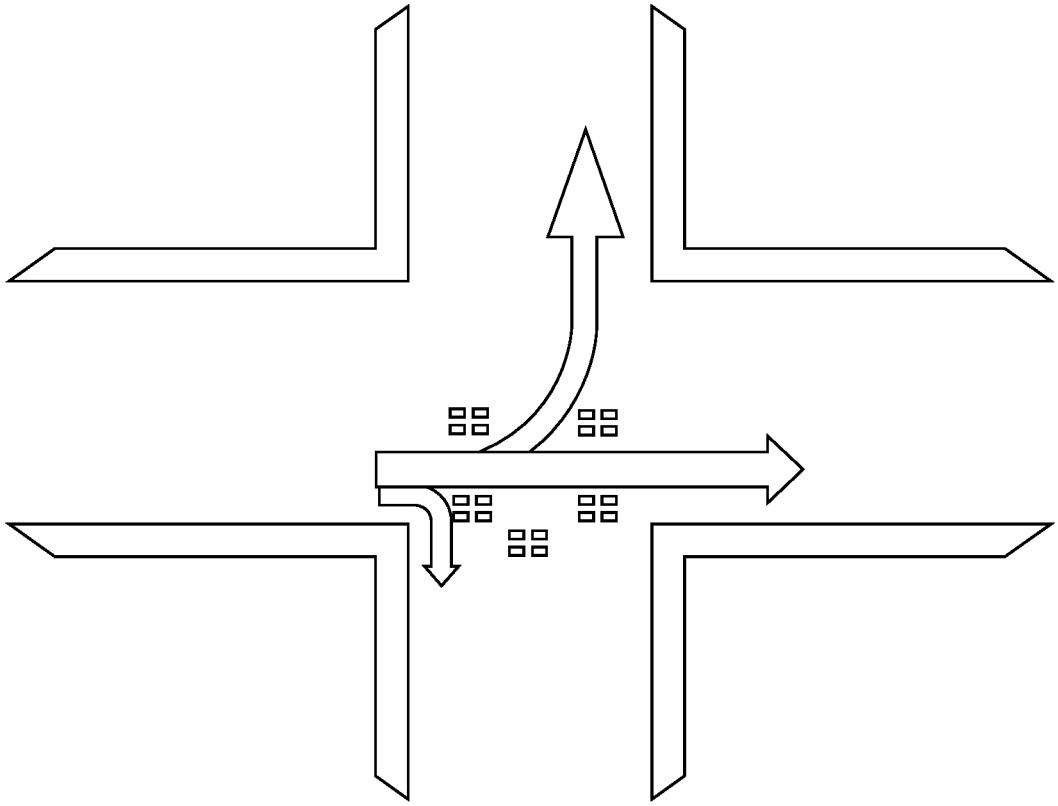
FIG. 10A is a schematic illustration of a plurality of selective tire-piercing devices on a roadway.
Figure 10B:
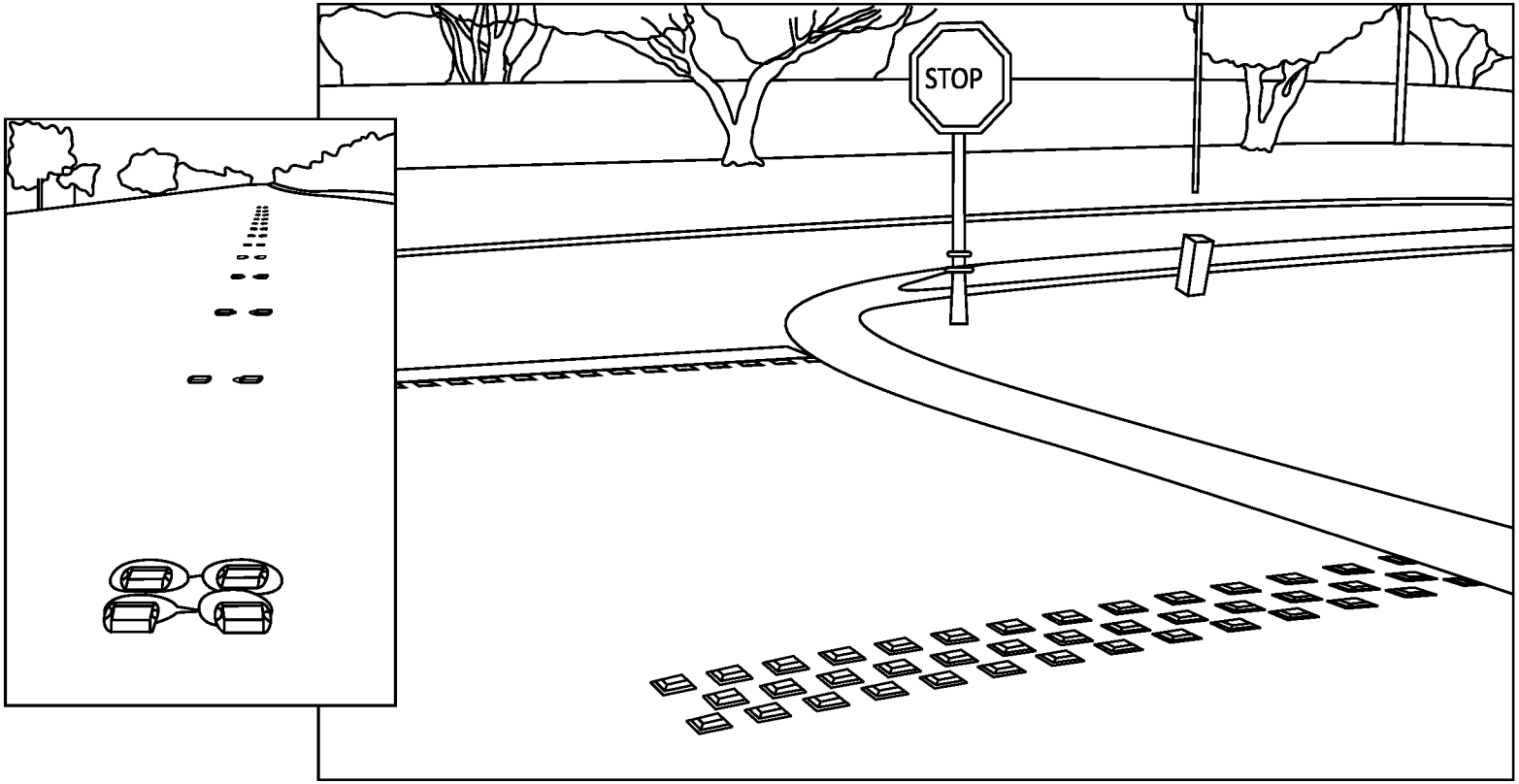
FIG. 10B is an illustration of a plurality of selective tire-piercing devices on a roadway.

FIGS. 10A and 10B illustrate an example of a plurality of selective tire-piercing devices on a roadway. A plurality of selective tire-piercing devices can be fixed to a roadway at an intersection and between lanes. Placement of the device in major intersections, open roadways, or other areas commonly usurped by a road show can thwart the persistence of such road shows and greatly increase public safety.

What is claimed is:

1. A car tire-impairment device, comprising:

a construct having a lateral surface, the construct made to withstand the flow of car traffic on a roadway;

a car tire piercing element extending out from the lateral surface, the car tire piercing element having a longitudinal axis extending out from the lateral surface and a lateral axis that is perpendicular to the longitudinal axis, the car tire piercing element being oriented downward and extending out from the lateral surface at an angle, wherein the car tire piercing element is configured to impair a sidewall of a car tire upon contact along the lateral axis with the sidewall of the car tire and allows the car tire to traverse, both forward and backward in direction along the longitudinal axis, over the car tire piercing element without impairing the car tire based on a combination of the downward orientation and a circular shape of the car tire.

2. The device of claim 1, wherein the construct further comprises:

a bottom surface adapted for coupling the construct to a surface of a paved roadway;

a top surface having essentially a same shape as the bottom surface but of proportionately smaller dimensions; and additional lateral surfaces, wherein all lateral surfaces connect the bottom surface to the top surface at an inward facing acute angle relative to the bottom surface.

3. The device of claim 1, further comprising:

a second car tire piercing element extending out from a second lateral surface, the second car tire piercing element being oriented downward to impair a sidewall of a car tire.

4. The device of claim 1, wherein the construct has a truncated rectangular pyramid shape.

5. The device of claim 4, wherein the truncated rectangular pyramid shape is a truncated square pyramid.

6. The device of claim 5, wherein the truncated square pyramid has a vertical height from about 1 inch to about 3 inches.

7. The device of claim 6, additionally comprising three more lateral surfaces, wherein each of the lateral surfaces of the truncated square pyramid has an angle of inclination of about 25° to about 60° relative to a bottom surface of the construct.

8. The device of claim 1, wherein the construct comprises a bottom surface, wherein the bottom surface is scored and is affixed to a roadway surface with an adhesive material.

9. The device of claim 1, wherein the construct comprises a bottom surface, wherein an elongate spike extends outward from the bottom surface, the spike being inserted into a hole drilled into a roadway surface and being affixed therein with an adhesive material.

10. The device of claim 9, wherein the hole comprises a pilot hole drilled into the roadway surface and wherein the elongate spike is threaded and is screwed into the pilot hole.

11. The device of claim 1, wherein the construct comprises a polymer, a composite, a metal, or any combination thereof.

12. The device of claim 1, wherein the piercing element is serrated.

13. The device of claim 1, wherein at least one surface of the device has a reflective characteristic.

14. A car tire-impairment device, comprising:

a construct comprising a top surface, a bottom surface, and lateral surfaces connecting the bottom surface to the top surface at an inward facing acute angle relative to the bottom surface, the bottom surface being configured for coupling the construct to a surface of a paved roadway, the top surface having essentially a same shape as the bottom surface but of proportionately smaller dimensions, and the construct being made to withstand car traffic of the roadway;

a first car tire piercing element affixed to a first lateral surface of the lateral surfaces and a second car tire piercing element affixed to a second lateral surface of the lateral surface, the first piercing element and the second piercing element each being oriented downward, wherein the first piercing element is affixed to the first lateral surface at an angle and the second piercing element is affixed to the second lateral surface at an angle, wherein the first piercing element and the second piercing element impair a sidewall of a tire traveling laterally to the first piercing element or the second piercing element and allow the tire to travel forward or backward longitudinally over the first piercing element or the second piercing element without impairing the tire based on a combination of the downward orientation and a circular shape of the car tire.

* * * * *